US006832945B2

(12) United States Patent
Shelton

(10) Patent No.: US 6,832,945 B2
(45) Date of Patent: Dec. 21, 2004

(54) BRA STRUCTURE HAVING RIGID UNDER-ARM SUPPORT MEMBERS

(76) Inventor: Christopher David Shelton, 24 Copenhagen Street, London N1 0JD (GB)

( * ) Notice: Subject to any disclaimer, the term of this patent is extended or adjusted under 35 U.S.C. 154(b) by 0 days.

(21) Appl. No.: 10/221,659

(22) PCT Filed: Mar. 15, 2001

(86) PCT No.: PCT/GB01/01156

§ 371 (c)(1),
(2), (4) Date: Nov. 25, 2002

(87) PCT Pub. No.: WO01/67901

PCT Pub. Date: Sep. 20, 2001

(65) Prior Publication Data

US 2003/0190861 A1 Oct. 9, 2003

(30) Foreign Application Priority Data

Mar. 15, 2000 (GB) ..... 0006310

(51) Int. Cl.[7] ..... A41C 3/00
(52) U.S. Cl. ..... 450/41; 450/86
(58) Field of Search ..... 450/1, 2–5, 39–41, 450/62–64, 86–88; 128/869, 870, 873, 874, 875; 2/73, 78.1–78.3, 267, 255–259, 264

(56) References Cited

U.S. PATENT DOCUMENTS

| | | | | | |
|---|---|---|---|---|---|
| 2,061,238 | A | * | 11/1936 | Klein | 450/39 |
| 2,686,312 | A | * | 8/1954 | Schmidt | 450/39 |
| 2,759,190 | A | * | 8/1956 | Herbener | 450/41 |
| 3,411,508 | A | * | 11/1968 | Sayers | 450/88 |
| 3,521,642 | A | * | 7/1970 | Jordan | 450/39 |
| 5,940,888 | A | * | 8/1999 | Sher | 2/267 |
| 6,110,007 | A | * | 8/2000 | Rittmann | 450/86 |

* cited by examiner

*Primary Examiner*—Gloria M. Hale
(74) *Attorney, Agent, or Firm*—Fay, Sharpe, Fagan, Minnich & McKee, LLP

(57) ABSTRACT

A bra structure comprising: (a) a frontal assembly including a pair of cup shaped support members; (b) a pair of shoulder straps each of which is adapted to extend forwardly and rearwardly over one shoulder of the wearer in use; (c) respective members for interconnecting the front and rear ends of each strap under the corresponding arm of the wearer. For each strap, the member for interconnecting the front and rear ends of the strap includes a rigid support member which is connected directly or indirectly to the rear end of the strap and also to the corresponding side of the frontal assembly, whereby the load of the frontal assembly is balanced between the front and rear ends of the strap.

18 Claims, 3 Drawing Sheets

BRA STRUCTURE HAVING RIGID UNDER-ARM SUPPORT MEMBERS

FIELD OF THE INVENTION

Human breasts are often supported by a garment known as a bra, whose main purpose is to transfer the forces involved in breast support to other body structures—principally the shoulders and the rib cage.

BACKGROUND OF THE INVENTION

This invention relates to a bra of the conventional type in which each shoulder of the wearer supports weight by means of a flexible band, usually of cloth, which passes over each shoulder and approximately at right angles to the line between the two shoulders; this is known as the bra strap. In other arrangements the band passes around the neck—the "halter neck" bra—the present invention is not concerned with these. In a conventional bra it is tension in the front part of each bra strap which carries the weight of each breast.

In order to stabilise the position of the structure, some means must be provided to ensure that the bra strap tension is equalised front to back. The breast weight, however, is in front only and this, in the conventional bra, has to be balanced by equal forces produced in the remainder of the bra structure. A major contribution to this is made by the back band tension and the forces in the bra wings. Distortion is common and the back band often rises to equilibrate forces with the vertical strap tension at the back.

SUMMARY OF THE INVENTION

The present invention seeks to provide a bra structure in which the strap tension can be better equalised front and back so as to avoid distortion of the structure and consequent discomfort for the wearer by halving the strap tension.

Accordingly the present invention provides a bra structure comprising:

(a) a frontal assembly including a pair of cup shaped support members;

(b) a pair of shoulder straps each of which is adapted to extend forwardly and rearwardly over one shoulder of the wearer in use;

(c) respective means for interconnecting the front and rear ends of each strap under the corresponding arm of the wearer;

for each strap, the means for interconnecting the front and rear ends of the strap including a rigid support member which is connected directly or indirectly to the rear end of the strap and also to the corresponding side of the frontal assembly, whereby the load of the frontal assembly is balanced between the front and rear ends of the strap.

Preferably the means for interconnecting the front and rear ends of each strap comprises a rigid support member whose lower end is connected to the rear end of the strap and whose upper end is connected to an upper region of the corresponding side of the frontal assembly to which the front end of the strap is also attached.

In this way the bra strap tension can be equilibrated front and back so as to provide a stable node capable of supporting the breast weight.

An additional strap member may be provided which extends between the two rigid support members, and is connected to each of them at a point which is offset in a vertical plane from the connection point with the interconnecting means, in such a way as to counteract any tendency of the front end of each rigid support member to rotate downwardly, under the load from the frontal assembly.

In one embodiment the additional strap member is connected to each rigid support member at a point which is above the connection point and is arranged to extend across the back of the wearer.

In another embodiment the additional strap member is connected to each rigid support member at a point which is below the connection point and is arranged to extend across the front of the wearer, below the frontal assembly.

BRIEF DESCRIPTION OF THE DRAWINGS

Some embodiments of the invention will now be described by way of example with reference to the accompanying drawings, in which.

DETAILED DESCRIPTION OF THE PREFERRED EMBODIMENTS

Figure 1:
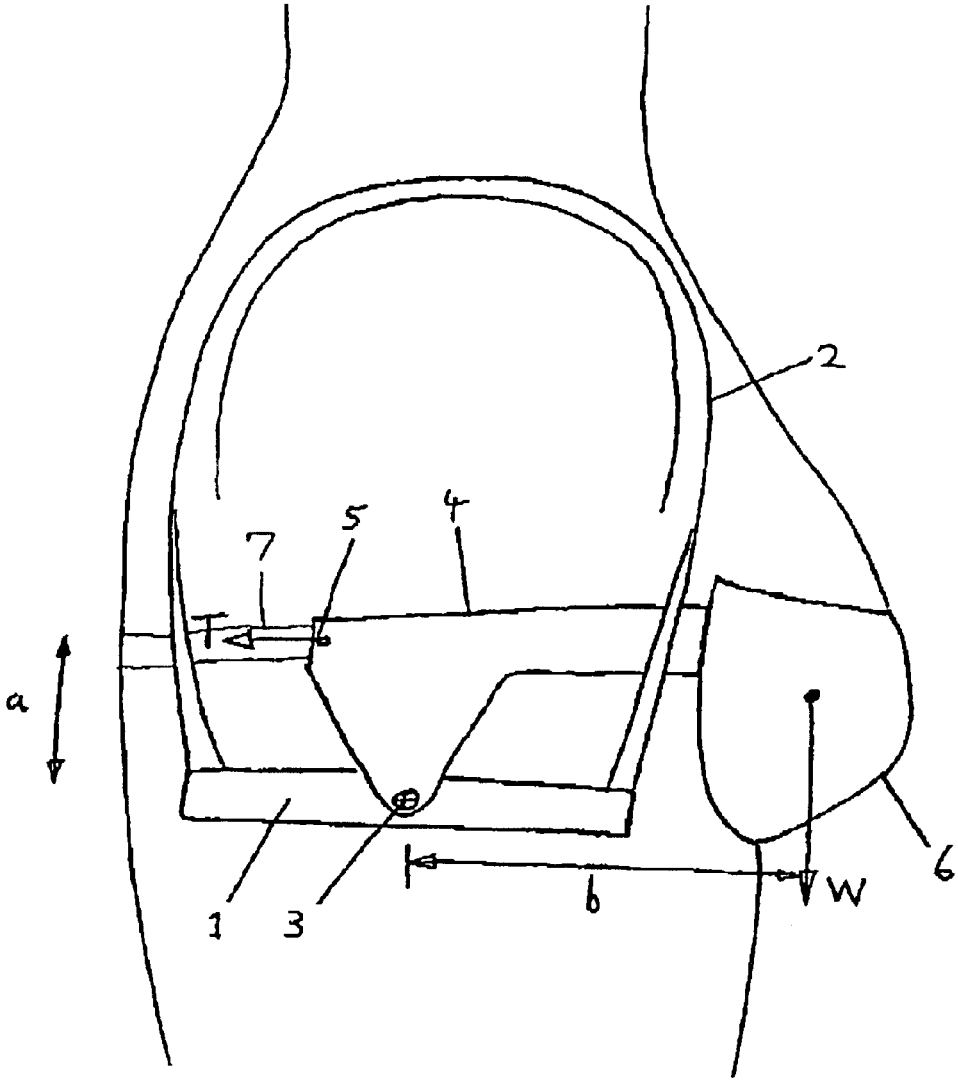
FIG. 1 is a diagrammatic side elevation view of a first embodiment of a bra structure.
Figure 2:
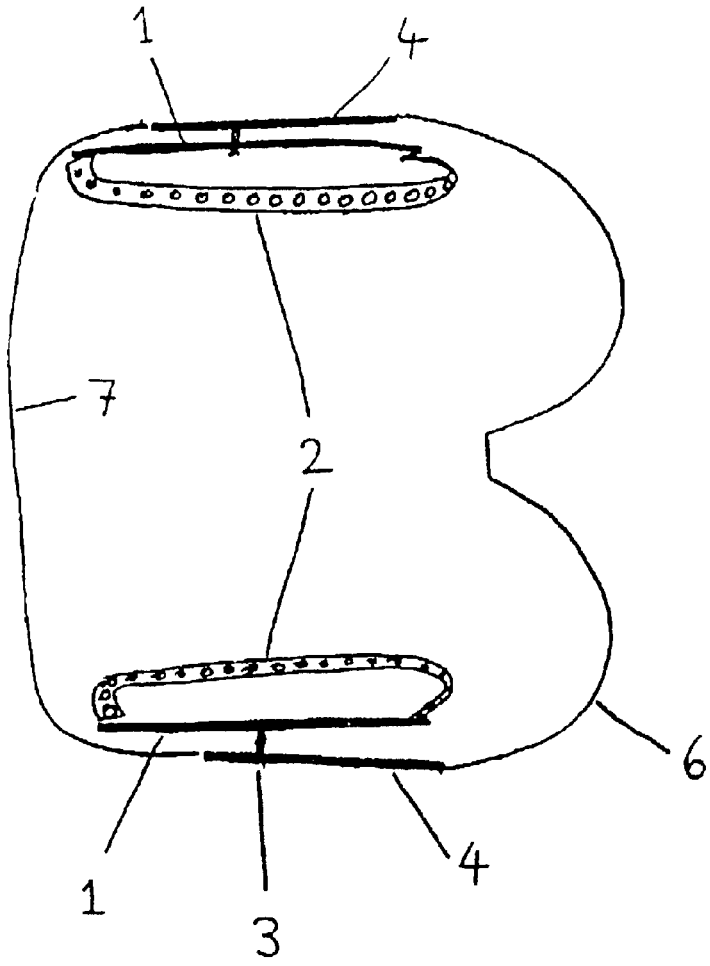
FIG. 2 is a diagrammatic plan view of the arrangement of FIG. 1.

Referring to FIG. 1, a rigid interconnecting member 1 joins the two ends of the shoulder strap 2, and midway (in side elevation) between the points where the straps are attached is a node of balance or pivotable connection 3. At this node of balance 3, a rigid support member 4 is pivotally connected. As shown in FIGS. 1 and 2 a back band or additional strap member 7 is connected between the rear ends 5 of the two rigid support members 4 and supplies a tension T. The weight of a breast is W and is carried by a cup 6, which is attached to the front end of the rigid support member 4.

The loads on the structure can be analysed as follows:

If the vertical distance between the back band attachment point 5, and the node of balance or pivotable connection 3 is "a", (FIG. 1) and the horizontal distance between the node of balance 3 and the point at which the weight W of the breast can be considered to act is "b".

Resolving moments about the node of balance 3:

$$Wb=Ta$$

It can be seen that component 1 is in equilibrium and it functions to ensure that the weight is carried equally by both the front and back of the bra strap. Resolving forces in component 1 vertically:

$$W=\text{front strap tension}+\text{back strap tension}$$

i.e. the strap tension is W/2—half that of a conventional bra strap. Also the tension T is balanced horizontally by a front chest tension through the frontal assembly (the same as in a conventional bra).

Although the rigid interconnecting member 1 is illustrated as a rigid elongate link, its length could be reduced—even to zero. The two ends of each shoulder strap would be connected directly together, under the arm of the wearer, since this would still provide a stable node of balance 3 for connection of the rigid support member 4.

In addition, the rigid support member 4 can be made in various different shapes. In the illustrated embodiment it is shown as generally T-shaped with the ends of the arms of the T, and the lower end of the leg of the T, forming connection points to the other parts of the structure. However the rearwardly extending arm of the T is not strictly necessary for it to function in the required manner, so it could be replaced by a more simply shaped member, having part connected to the interconnecting member 1 at the balance point 3, and the other part connected to the corresponding side of the frontal assembly. The back band 7 would then be connected to it, above the balance point 3.

The back tension may also be applied directly to the interconnecting member 1, or directly to the support node 3; such tension components are to prevent any tendency of the rigid support member to rotate.

In an alternative arrangement a front band (not illustrated could be provided to stabilize the rigid support members 4. The front band could be connected to each of the rigid support members below the connection point 3 rather than above it so that it would still counteract the tendency of the rigid support member 4 to rotate.

However in this case it will be necessary to provide a retaining strap, such as back band 7, extending across the back of the wearer, which may be connected either between the interconnecting members 1, or between the rigid support members 4.

Figure 3:
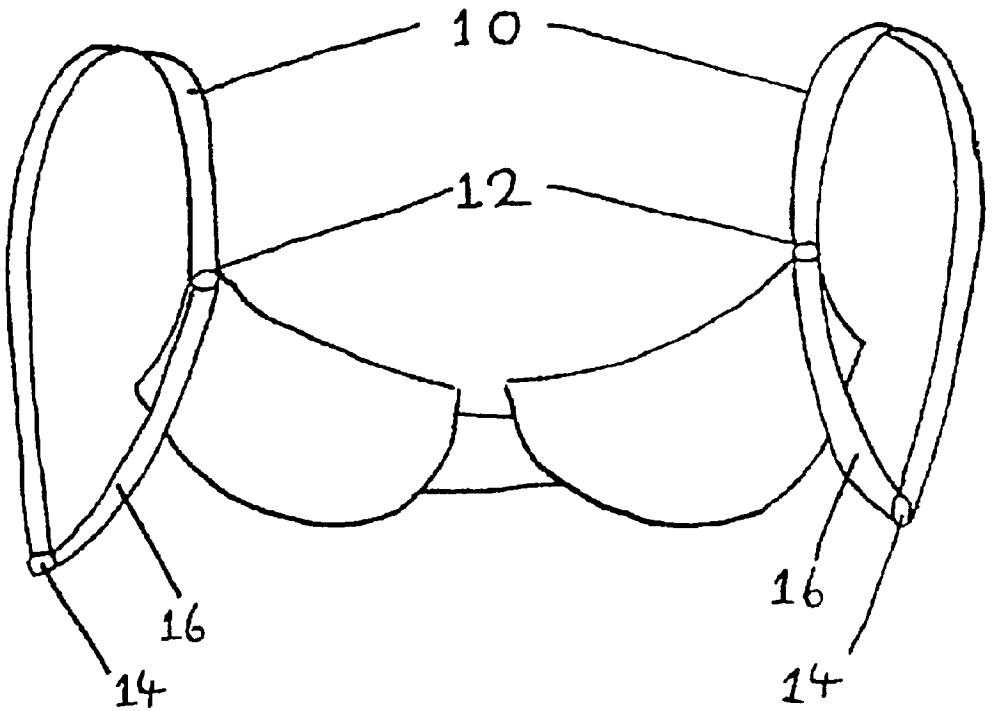
FIG. 3 is a perspective frontal view of an alternative embodiment.

FIG. 3 illustrates an alternative embodiment in which the shoulder strap 10 has its front end 12 connected to the upper region of one side of the frontal cup assembly, while its lower rear end 14 is connected to an upwardly extending rigid link U support member or strut 16. The upper end of the link 16 is also connected to the upper region of the frontal assembly, and in this way the link acts to interconnect the front and rear ends of the strap, whilst at the same time acting to directly support the weight of the corresponding side of the frontal assembly. Compared to the embodiment of FIG. 1, the structure is thus considerably simplified because only a single rigid link (16) is required on each side to achieve the same supporting effect as both of the interconnected rigid members 1 and 4 of the first embodiment.

What is claimed is:

1. A bra structure comprising:

(a) a frontal assembly including a pair of cup shaped support members to support a breast load;

(b) a pair of shoulder straps each having a front end and a rear end adapted to extend respectively forwardly and rearwardly over one shoulder of the wearer in use; and (c) respective means for interconnecting the front and rear ends of each strap under the corresponding arm of the wearer;

for each strap, the means for interconnecting the front end rear ends of the strap including a rigid support member which is connected to the rear end of the strap and also to a corresponding side of the frontal assembly, whereby the load of the frontal assembly is balanced between the front end rear ends of the strap.

2. A bra structure according to claim 1 in which the means for interconnecting the front and rear ends of each strap comprises a rigid support member whose rear end is connected to the rear end of the strap and whose front end is connected to an upper region of the corresponding side of the frontal assembly the front end of the strap also being attached to the corresponding side of the frontal assembly.

3. A bra structure according to claim 1 in which the means for interconnecting the front and rear ends of each shoulder strap further includes a rigid interconnecting member between the ends of each shoulder strap and wherein the rigid support member is connected to a central region of the rigid interconnecting member at a connection point, so as to distribute the load of the corresponding side of the frontal assembly evenly between the two ends of the strap.

4. A bra structure according to claim 3 further comprising an additional strap member which extends between the two rigid support members, and is connected toe rear end of each of them at a point which is offset in a vertical plane from the connection point with the rigid interconnecting member, in such a way as to counteract any tendency of the front end of each rigid support member to rotate downwardly, under the load from the frontal assembly.

5. A bra structure according to claim 4 in which the additional strap member is connected to each rigid support member at a point which is above the connection point and is arranged to extend across the back of the wearer.

6. A bra structure according to claim 3 further comprising an additional strap member connected between both rigid support members and arranged to extend across the back of the wearer.

7. A bra structure according to claim 4 in which each rigid support member comprises a first portion which extends forwardly from the connection point, to the frontal assembly, and a second portion which extends rearwardly and/or upwardly for connection of the additional strap members, which functions as a back band of the bra structure.

8. A bra structure according to claim 5 in which each rigid support member comprise a first portion which extends forwardly from the connection point, to the frontal assembly, and a second portion which extends downwardly for connection of the additional strap member.

9. A bra structure according to claim 1 wherein the means for interconnecting the front and rear ends of each shoulder strap comprises a pivotable connection located between the ends of the rigid support member.

10. A bra structure comprising:

(a) a frontal assembly having a left and a right side, including a pair of cup shaped support members to support a breast load;

(b) a pair of shoulder straps each having a front end extending to the front of the wearer and a rear end extending to the back of the wearer; and (c) respective means for interconnecting the front and rear ends of each strap under the corresponding arm of the wearer;

the interconnecting means including a rigid support member beneath each strap and a means for connecting each rigid support member to the corresponding side of the frontal assembly, whereby the load of the frontal assembly is balanced between the front and rear ends of the strap.

11. A bra structure according to claim 10 in which each rigid support member includes a rear end which is connected to the rear end of the respective shoulder strap and a front end which is connected to an upper region of the corresponding side of the frontal assembly and wherein the front end of each shoulder strap is also attached to the corresponding side of the frontal assembly.

12. A bra structure according to claim 10 in which the means for interconnecting the front and rear ends of each shoulder strap further includes a rigid interconnecting member which is connected to a central region of the rigid support member at a connection point so as to distribute the load of the corresponding side of the frontal assembly evenly between the two ends of the respective shoulder strap.

13. A bra structure according to claim 12 further comprising an additional strap member which extends between the two rigid support members, and is connected to each of them at a point which is offset in a vertical plane from the connection point with the rigid interconnecting member, in such a way as to counteract any tendency of the front and of each rigid support member to rotate downwardly, under the load from the frontal assembly.

14. A bra structure according to claim 12 in which the additional strap member is connected to each rigid support member at a point which is above the connection point and is arranged to extend across the back of the wearer.

15. A bra structure according to claim 12 further comprising a back band connected between both rigid support members or both interconnecting means and arranged to extend across the back of the wearer.

16. A bra structure according to claim 13 in which each rigid support member comprises a first portion which extends forwardly from the connection point, to the frontal assembly, and a second portion which extends rearwardly and/or upwardly for connection of the said additional back strap member.

17. A bra structure according to claim 13 in which each rigid support member comprises a first portion which extends forwardly from the connection point, to the frontal assembly, and a second portion which extends downwardly for connection of the additional strap member.

18. A bra structure comprising:

(a) a frontal assembly including a pair of cup shaped support members to support a breast load;

(b) a pair of shoulder straps each having a front end and a rear end adapted to extend respectively forwardly and rearwardly over one shoulder of the wearer in use; and (c) respective members for interconnecting the front and rear ends of each strap under the corresponding arm of the wearer;

for each strap, the members for interconnecting the front and rear ends of the strap including a rigid support member which is connected to the rear end of the strap and also to a corresponding side of the frontal assembly, whereby the load of the frontal assembly is balanced between the front and rear ends of the strap.

* * * * *